United States Patent [19]

Nozaki

[11] 4,020,192

[45] Apr. 26, 1977

[54] XEROGRAPHIC REPRODUCTION PROCESS AND TONER CARRIER FOR USE THEREWITH

[75] Inventor: Toll Nozaki, Minami-ashigara, Japan

[73] Assignee: Fuji Xerox Co., Ltd., Tokyo, Japan

[22] Filed: Sept. 9, 1974

[21] Appl. No.: 504,387

[30] Foreign Application Priority Data

Sept. 10, 1973 Japan ..... 48-101085

[52] U.S. Cl. ..... 427/19; 96/1 SD; 252/62.1 P; 428/407

[51] Int. Cl.[2] ..... B05D 1/06; G03G 13/06

[58] Field of Search ..... 252/62.1 P; 96/1 SD; 427/14, 19; 428/407

[56] References Cited

UNITED STATES PATENTS

| | | | |
|---|---|---|---|
| 3,533,835 | 10/1970 | Hagenbach et al. | 252/62.1 P |
| 3,558,492 | 1/1971 | Proskow | 252/62.1 P |
| 3,658,500 | 4/1972 | Hagenbach | 252/62.1 P |
| 3,800,554 | 5/1974 | Merrill et al. | 252/62.1 |
| 3,811,880 | 5/1974 | Browning | 96/1.4 |
| 3,916,065 | 10/1975 | Moriconi et al. | 427/14 |

*Primary Examiner*—David Klein
*Assistant Examiner*—Judson R. Hightower
*Attorney, Agent, or Firm*—Gerald J. Ferguson, Jr.; Joseph J. Baker

[57] ABSTRACT

A xerographic reproduction process and toner carrier for use therewith, the process comprising the steps of forming an electrostatic latent image on a recording layer and developing the image with a developer comprising a toner and a carrier, the carrier comprising a core coated with an organic polymer coating containing a monomer unit selected from the group consisting of

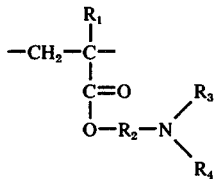

(I)

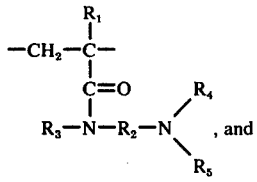

(II)

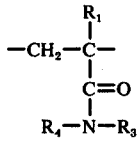

(III)

(wherein $R_1$, $R_3$, $R_4$, and $R_5$ is each a hydrogen atom or a hydrocarbon residue having 1 to 12 carbon atoms, and $R_2$ is a hydrocarbon residue having 1 to 12 carbon atoms).

17 Claims, No Drawings

XEROGRAPHIC REPRODUCTION PROCESS AND TONER CARRIER FOR USE THEREWITH

BACKGROUND OF THE INVENTION

1. Field of the Invention

This invention relates to an improved xerographic reproduction process and an improved toner carrier used therewith.

2. Discussion of the Prior Art

It is known that by electrostatic means an image may be formed on the surface of a photoconductive material and developed. According to a basic xerographic method disclosed in the specification of U.S. Pat. No. 2,297,691, a uniform static charge is applied on a photoconductive insulating layer and the layer is exposed to light through a dark-light image, charge bing discharged at light-exposed areas on the layer to form an electrostatic latent image. Development of the image is effected by attracting a fine, electrically charged material called "toner" to the latent image on the surface of the layer. Then, the powder image may be transferred to the surface of a support such as paper, where the transferred image is permanently fixed on the surface of the support by, for instance, heating or the like. Instead of forming a latent image by uniformly charging the photoconductive layer and exposing the layer to light through a dark-light image, it is possible to form a latent image by charging the layer imagewise. It is also possible to omit the step of transferring the powder image whereby the powder image is fixed on the photoconductive layer. Of course, it is also possible to adopt a solvent treatment or coating treatment instead of the above heat fixing step.

Many methods are known for applying a toner to an electrostatic latent image. For instance, there is the "cascade" development method disclosed in the specification of U.S. Pat. No. 2,618,552. According to this method, the developing material may comprise a carrier powder of a relatively large size and the fine toner powder electrostatically attracted thereto. The developing material is rolled or cascaded across the latent image bearing surface. The material of the carrier powder is so selected that the toner powder is triboelectrically charged to a desired polarity. When the mixture of carrier powder and toner powder is rolled or cascaded across the image charged surface, the toner powder is electrostatically attracted to the charged area of the latent image, but not to the non-charged area of the image, namely the background area. The majority of the toner powder which happens to be applied to the background area is attracted back to the carrier and circulated again, because the electrostatic attraction between the toner and carrier is higher than the attraction between the toner and background area. This method is especially suitable for development of line images.

Another method for developing electrostatic images is the so-called "magnetic brush" method disclosed, for instance, in the specification of U.S. Pat. No. 2,874,063. According to this method, a developing material comprising a toner and a magnetic carrier powder is supported by a magnet, and the magnetic field of this magnet arranges the magnetic carrier in a brush-like form. This magnetic brush engages the electrostatic image bearing surface and the toner powder is drawn to the electrostatic image by electrostatic attraction.

The two foregoing methods have been generally adopted in the art. In the cascade method, small buckets on an endless belt raise developing material from a reservoir and carry it to the electrostatic image. The developer mixture is then cascaded or rolled across the electrostatic image bearing surface by gravity. All the carrier particles are then returned to the reservoir together with an unused toner powder, and circulated again through the development apparatus. In this method, the above procedure is repeated for each copy made by the machine, and in general, the above procedure is repeated several thousand times for the effective life of the developer. In this method and the magnetic brush method and other development methods, the developer mixture undergoes mechanical abrasion and is degraded by long-time use. Degradation of the carrier particles is characterized in that a part or all of the carrier coating is separated from the carrier core. The separated coating is either a fragment or the entire coating layer. The separation mainly results from a poor adhesive force between the coating material and its core. Separation mainly occurs upon collision or frictional contact with machine parts or other particles. A carrier having a coating which is likely to be separated from the carrier core in the form of a fragment, or otherwise must be replaced frequently thus undesirably increasing the copying costs both in terms of material expended and time consumed maintaining the machine. If carrier particles having a damaged coating are not replaced, printing defects result and printing a poor quality occurs.

In most carriers, the triboelectric and flow characteristics are adversely affected by high relative humidity. For instance, the triboelectric value of some carrier coatings varies with change in relative humidity, and such carriers are not suitable for use in a xerographic apparatus.

Another factor having influence on the stability of triboelectric characteristics of the carrier is that the carrier coating tends to undergo "toner impaction". That is, if the carrier particles are used in an automatic machine and are circulated several thousand times, many collisions occur between the carrier particles and other surfaces in the machine and tend to imbed toner powder. This may also occur because of other causes. As the amount of the toner permanently adhered to the carrier particle surface increases, the triboelectric value of the carrier particles changes and the amount of toner the carrier can carry is permanently lessened or destroyed, thereby deteriorating the quality of copies.

Further, the toner and carrier particles of a developing material should be selectively attracted to the electrostatic image and thus the toner must have the correct charge polarity and quantity. If the triboelectricity is too low, image background will be extremely contaminated. If triboelectricity is too high, the background will be clean and free from contamination, but the image concentration is so low that in some instances, the resulting image will be substantially illegible. In other words, there is an optimum range of triboelectricity for obtaining best overall results. A great variety of carriers are now used in automatic copying machines, but each of them has specific characteristics and most of them produce a high triboelectric charge on some kinds of toners and a low triboelectric charge on other kinds of toners. Thus, they are poor in overall characteristics.

SUMMARY OF THE INVENTION

It is therefore a primary object of this invention to provide an improved xerographic reproduction process and a carrier having an improved coating which can overcome the foregoing shortcomings of the conventional techniques and which can be tightly bonded to the carrier core.

Another object of this invention is to provide an improved process and a carrier coating which has a stable triboelectric value regardless of the ambient atmosphere conditions.

A further object of this invention is to provide an improved process and a carrier coating which is resistant to collisions with toner particles.

A still further object of this invention is to provide an improved process and a carrier coating which has a triboelectric value within a certain range even when different kinds of toners are used.

Still another object of this invention is to provide an improved process and a carrier coating, the triboelectric value of which can readily be adjusted.

DETAILED DESCRIPTION OF THE PREFERRED EMBODIMENTS

The foregoing objects can be attained by employing, in a xerographic process a coating material for a carrier comprising an organic polymer containing at least one of the monomer units expressed by the following formulas.

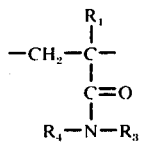

(I)

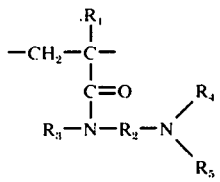

(II)

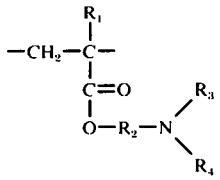

(III)

(wherein $R_1$, $R_3$, $R_4$ and $R_5$ stand for a hydrogen atom or a hydrocarbon residue having 1 to 12 carbon atoms, and $R_2$ stands for a hydrocarbon residue having 1 to 12 carbon atoms).

A polymer component used in the carrier coating of this invention may be a homopolymer of any one of the above monomer units, a copolymer of any one of the above monomer units with at least one other comonomer, a polymer product obtained by modifying a monomer having a chemical structure other than the above structures to convert it to a polymer having any one of the above units, or a mixture of any of the foregoing polymers with at least one other polymer.

It is preferable that the organic polymer coating have about 0.05 to about 50% by weight or about 75% to about 90% by weight of the above monomer units specified in this invention, because optimum coating characteristics and optimum triboelectric values are given by such polymers. In general, good results can be obtained when the organic polymer coating has about 0.01% by weight to 100% by weight of the monomer units specified above.

The thickness of the polymer coating is optional, but it is generally preferred that the coating be sufficiently thick to form a thin continuous film typically at least about 0.1 $\mu$ thick since the carrier coating will then be able to resist abrasion and prevent the formation of pin holes therein which can have a bad influence on the frictional characteristics of the carrier particles.

The high-molecular-weight, film-forming polymer used in the carrier coating of this invention may be prepared by customary vinyl polymerization or by subjecting a polymer to a chemical reaction. The polymerization vessel used for forming the coating polymer by vinyl polymerization may be any of the ordinary polymerization vessels used in this field. The polymerization can be by any of the bulk polymerization, suspension polymerization, emulsion polymerization and solution polymerization methods. In order to facilitate coating of the polymer on the carrier core, it is preferred that the coating polymer be prepared by the solution polymerization method. If the coating polymer is prepared by chemical reaction of other polymers, ordinary reaction vessels can be employed.

In order to incorporate the above monomer units of chemical structure (I) into the polymer of this invention by homopolymerization or copolymerization, there may be employed, for example, amino methacrylate compounds such as dimethylaminomethyl methacrylate, dimethylaminoethyl methacrylate, dimethylaminopropyl methacrylate, dimethylaminohexyl methacrylate, dimethylaminodecyl methacrylate, diethylaminoethyl methacrylate, diethylaminopropyl methacrylate, diethylaminobutyl methacrylate, diethylaminohexyl methacrylate, diethylaminodecyl methacrylate dipropyl aminoethyl methacrylate and dibutylaminoethyl methacrylate; and amino acrylate compounds such as dimethylaminomethyl acrylate, dimethylaminoethyl acrylate, dimethylaminopropyl acrylate, dimethylaminohexyl acrylate, dimethylaminodecyl acrylate, diethylaminoethyl acrylate, diethylaminopropyl acrylate, diethylaminobutyl acrylate, diethylaminohexyl acrylate, diethylaminodecyl acrylate, dipropylaminoethyl acrylate and dibutylaminoethyl acrylate. In the case of copolymerization, another comonomer is employed.

As a polymer into which the above chemical structure (I) may be incorporated by chemical reaction, there may be used, for example, homopolymers having a reactive carbonyl group, such as polymethacrylic acid, esters thereof, polyacrylic acid and esters thereof, e.g., polymethaacrylic acid, polymethyl methacrylate, polyethyl methacrylate, polypropyl methacrylate, polybutyl methacrylate, polyacrylic acid, polymethyl acrylate, polyethyl acrylate, polypropyl acrylate and polybutyl acrylate; and copolymers and terpolymers comprising any of these monomer units. In the case of copolymers and terpolymers, ordinary vinyl monomers are employed as comonomers. The reagent to be reacted with the foregoing polymers is a compound having the following general formula (IV).

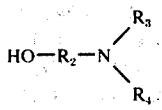

(IV)

(wherein $R_2$, $R_3$ and $R_4$ are defined as above).

In order to incorporate the above monomer units of the chemical structure (II) into the polymer of this invention by homopolymerization or copolymerization, there may be employed, for example, dialkylaminoalkyl methacrylamides such as dimethylaminoethyl methacrylamide, dimethylaminopropyl methacrylamide, dimethylaminobutyl methacrylamide, dimethylaminohexyl methacrylamide, dimethylaminodecyl methacrylamide, diethylaminoethyl methacrylamide, diethylaminobutyl methacrylamide, dipropylaminoethyl methacrylamide and dibutylaminoethyl methacrylamide; dialkylaminoalkyl acrylamides such as dimethylaminoethyl acrylamide, dimethylaminopropyl acrylamide, dimethylaminobutyl acrylamide, dimethylaminohexyl acrylamide, dimethylaminodecyl acrylamide, diethylaminoethyl acrylamide, diethylaminobutyl acrylamide, dipropylaminoethyl acrylamide and dibutylaminoethyl acrylamide. In the case of copolymerization, another comonomer is employed.

The same polymers mentioned with respect to chemical structure (I) may be used as polymers into which monomer units of chemical structure (II) are incorporated by chemical reaction. The reagent to be reacted with such polymers is a compound having the following general formula (V).

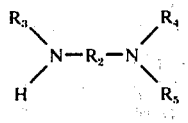

(V)

(wherein $R_2$, $R_3$, $R_4$ and $R_5$ are as defined above).

However, the synthesis of a reagent having the above chemical structure requires a long reaction route. Therefore, instead of using the above chemical structure, the polymer can first be reacted with a compound of the following general formula (VI)

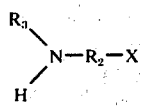

(VI)

(wherein $R_2$ and $R_3$ are as defined above, and X is a halogen atom), and then reacted with a compound of the following general formula (VII)

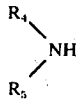

(VII)

(wherein $R_4$ and $R_5$ are defined as above).

It is also possible to react the polymer at first with a compound having the following general formula (VIII)

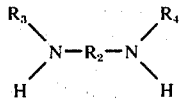

(VIII)

(wherein $R_2$, $R_3$ and $R_4$ are as defined above), and then with a compound having the following general formula (IX)

$$X-R_5 \qquad \text{(IX)}$$

(wherein $R_5$ is as defined above, and X is a halogen atom).

In order to incorporate monomer units of chemical structure (III) into the polymer of this invention by homopolymerization or copolymerization, there may be employed, for example, dialkyl methacrylamides such as dimethyl methacrylamide, diethyl methacrylamide, dipropyl methacrylamide, dibutyl methacrylamide, dioctyl methacrylamide, methylethyl methacrylamide and ethylpropyl methacrylamide; and dialkyl acrylamides such as dimethyl acrylamide, diethyl acrylamide, dipropyl acrylamide, dibutyl acrylamide, dioctyl acrylamide, methylethyl acrylamide and ethylpropyl acrylamide. In the case of copolymerization, another comonomer is employed.

If the monomer units of the above chemical structure (III) are incorporated by chemical reaction of a polymer, the same polymers mentioned with respect to the incorporation of monomer units of chemical structure (I) by chemical reaction may be employed. The reagent to be reacted with the polymer is a compound having the following general formula (X)

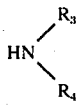

(X)

(wherein $R_3$ and $R_4$ are as defined above).

As the comonomer which may be used for the formulation of copolymers having the above chemical structures (I), (II) or (III), there may be, for example, alkyl acrylates, alkyl methacrylates, cycloalkyl acrylates, cycloalkyl methacrylates, hydroxyalkyl acrylates, hydroxyalkyl methacrylates, acrylamide, methylamide, alkylol acrylamides, alkylol methacrylamides, acrylonitrile, methacrylonitrile, styrene, vinyltoluene, vinyl acetate and vinyl chloride.

In forming a carrier coating material of this invention, an optional appropriate resin may be incorporated with the foregoing polymer or modified polymer. As such a resin, there may be used natural resins, modified natural resins and synthetic resins prepared by appropriate methods such as addition polymerization, polycondensation and the like.

Optional appropriate coated and uncoated carrier materials can be used as carrier cores in this invention. Typical carrier core substances include sodium chloride, ammonium chloride, potassium aluminum chloride, Rochelle salt, sodium nitrate, potassium chlorate, granular zirconium, granular silicon, polymethyl methacrylate, glass, silicon dioxide, flint shot, iron, steel ferrite, nickel, carborundum and mixtures thereof. It is desired that carriers selected from the above exemplified substances have a diameter of about 40 to about 600 μ because carriers having a particle size within the above range have weight and inertia sufficient to prevent the carrier powder from adhering to an electrostatic latent image during a cascade development step. The carrier particles should not adhere to the electrostatic photographic drum, because carriers adhering to the drum deeply scar the drum surface during the image-transferring and drum-cleaning steps.

Surprisingly good results are obtained by employing the polymer of this invention as the coating material. For instance, though not completely understood, the carrier coating has high resistance to toner impaction and is apparently at least partially due to the amine and amide groups tightly bonded to the carrier core. Further, though not completely understood, there is no substantial difference of triboelectric charge even when a variety of different toners are employed, and the coated carrier of this invention can be equally used for all of these toners. It is thought that the presence of the amide and amino groups may probably make some contribution in attaining this advantage.

The polymeric coating composition of this invention may be applied to the carrier core by various conventional methods, for example, the powder-spraying method, the immersing method, the fluidized bed coating method or the like. The polymers or mixtures thereof may be applied in various ways, such as powder, dispersion, emulsion or high temperature melt. Use of a solvent having a relatively low boiling point is preferred. The reason is that after application to the carrier core, a small quantity of energy and short time are sufficient for removal of the solvent. Typical solvents include halogenated aliphatic hydrocarbons such as chloroform, 1,2-dichloroethane and trichloroethlene, and aromatic hydrocarbons such as toluene and o-dichlorobenzene. The carrier coating may have an optional appropriate thickness but it should have a thickness sufficient to resist flaking and chipping. The amount of the polymer applied to the carrier core depends on the surface area of the carrier core and the coating thickness. In a typical instance, the coated carrier contains about 20 to about 1000 g of the coating material per 50 Kg of flint shot carrier particles having an average diameter of about 600 μ. Electrically chargeable toner materials having incorporated therein pigments or dyes, if desired, may be used in combination of the coated carrier of this invention. Typical toner substances are cumarone-indene resin, asphalt, phenol-formaldehyde resin, rosin-modified phenol-formaldehyde resin, methacrylic acid resin, polystryene, polypropylene, epoxy resin, polyethylene, etc. Typical toner materials are also disclosed in the specifications of U.S. Pat. Nos. 2,659,670; 2,753,308; and 3,079,342.

Preparation of the carrier materials of this invention and utilization of these carriers for development of electrostatic images will now be illustrated in more detail in the following Examples, in which all "parts" and "percentages" are by weight unless otherwise indicated.

COMPARATIVE EXAMPLE

A glass reaction vessel was charged with about 15 parts of styrene, about 85 parts of methyl methacrylate and about 0.5 parts azobisisobutyronitrile, and 40 parts of toluene was added thereto. Nitrogen gas was blown into the reaction vessel to replace the inside atmosphere with nitrogen. The mixture was heated at about 80° C. under atmospheric pressure for 24 hours under agitation. The resulting styrene-methyl methacrylate copolymer was cooled and taken from the reaction vessel. The weight average molecular weight of this copolymer was about 170,000 as measured by the light scattering method. A toluene solution containing about 10% of this copolymer was applied to granular steel having a diameter of 450 μ in an amount sufficient to form a thin continuous film. After drying, the triboelectric charge between the resulting coated granular steel and various toners was determined to obtain the results shown in Table I.

TABLE I.

| Toner No. | Pigment | Triboelectric Charge (μc/g) |
|---|---|---|
| 1 | Neospectra M-II | 16.0 |
| 2 | Black Pearl L | 15.8 |
| 3 | Mitsubishi No. 45 | 6.4 |
| 4 | Cyan | 14.3 |
| 5 | Yellow | 2.0 |
| 6 | Magenta | 3.2 |
| 7 | Mitsubishi No. 600 | 5.6 |
| 8 | Tokai Seast | 1.4 |
| 9 | Tokai Seast 3H | 2.0 |
| 10 | Mitsubishi No. 33 | 8.1 |
| 11 | Mitsubishi No. 44 | 8.2 |
| 12 | Tokai Seagal 600 | 1.2 |

When developers composed of the above coated granular steel and the respective toners indicated above were used for development, copies having a dirty background were obtained except for the developers including toners No. 1, No. 2 and No. 4.

EXAMPLE 1

A glass reaction vessel was charged with about 98 parts of methyl methacrylate, about 2 parts of dimethylaminoethyl methacrylate and about 0.5 parts of azobisisobutyronitrile, and 40 parts of toluene was added thereto. Nitrogen gas was introduced into the reaction vessel to replace the inside atmosphere with nitrogen. The mixture was heated at about 80° C under atmosphere pressure for 24 hours under agitation. The resulting methyl methacrylate-dimethylaminoethyl methacrylate copolymer was cooled and taken out of the reaction vessel. The weight average molecular weight of this copolymer was about 130,000 as measured by the light scattering method. There was about 2% by weight dimethylaminoethyl methacrylates present. A toluene solution containing about 10% of this copolymer was applied to granular steel having a diameter of 450 μ in an amount sufficient to form a thin continuous film. After drying, the triboelectric charge between the resulting coated granular steel and various toners was determined to obtain the results shown in Table II. Developers composed of the coated granular steel and respective toners were employed for development. In each case, copies having a beautiful image and good image quality were obtained even after development has been repeated 400,000 times.

TABLE II

| Toner No. | Pigment | Triboelectric Charge (μc/g) |
|---|---|---|
| 2 | Black Pearl L | 23.0 |
| 3 | Mitsubishi No. 45 | 16.2 |
| 5 | Yellow | 15.3 |
| 6 | Magenta | 18.2 |
| 9 | Tokai Seast | 19.5 |

EXAMPLE 2

A glass reaction vessel was charged with about 20 parts of methyl methacrylate, about 80 parts of dimethylaminoethyl methacrylate, about 0.5 part of azobisisobutyronitrile and about 20 parts of toluene, and the reaction was conducted in the same manner as in Example 1 to obtain a copolymer having a molecular weight of about 100,000. There was about 80% by weight dimethylaminoethyl methacrylate present. This copolymer was coated on granular steel having a diameter of 450 $\mu$ in the same manner as in Example 1, and the triboelectric charge was determined with respect to various toners, to obtain the results shown in Table III.

TABLE III

| Toner No. | Pigment | Triboelectric Charge ($\mu$c/g) |
|---|---|---|
| 2 | Black Pear L | 24.6 |
| 3 | Mitsubishi No. 45 | 20.1 |
| 5 | Yellow | 16.3 |
| 6 | Magenta | 17.2 |
| 8 | Tokai Seast | 15.4 |
| 10 | Mitsubishi No. 33 | 20.2 |

Developers composed of the above coated granular steel and the respective toners were used for development. In each case, copies having a beautiful image and good image quality were obtained even after development had been repeated 400,000 times.

EXAMPLE 3

A glass reaction vessel was charged with about 80 parts of polymethyl methacrylate, about 30 parts of dimethylaminoethyl alcohol, about 0.2 part of metallic sodium and about 50 parts of toluene, and the mixture was heated at 90° C for 40 hours under atmospheric pressure with stirring. In the reaction product, the degree of modification was about 18% by weight. A toluene solution containing about 10% of the resulting copolymer was applied to granular steel having a diameter of 450 $\mu$ in an amount sufficient to form a thin continuous film. After drying, the triboelectric charge between the coated granular steel and various toners was determined to obtain the results shown in Table IV.

TABLE IV

| Toner No. | Pigment | Triboelectric Charge ($\mu$c/g) |
|---|---|---|
| 1 | Neospectra M-II | 24.3 |
| 3 | Mitsubishi No. 45 | 18.2 |
| 7 | Mitsubishi No. 600 | 15.4 |
| 12 | Tokai Seagal 600 | 17.7 |

Developers composed of the coated granular steel and the respective toners were used for development. Copies having a beautiful image and good image quality were obtained in each case even after development had been repeated 500,000 times.

EXAMPLE 4

A glass reaction vessel was charged with about 60 parts of polymethyl acrylate, about 40 parts of diethylaminoethyl amine and about 50 parts of toluene, and the mixture was heated at about 90° C under atmospheric pressure for 40 hours under agitation. In the resulting reaction product, the degree of modification was about 31% by weight. A toluene solution containing about 10% of the so obtained copolymer was applied to granular steel having a diameter of 450 $\mu$ in an amount sufficient to form a thin continuous film. After drying, the triboelectric charge between the resulting coated granular steel and various toners was determined to obtain the results shown in Table V.

TABLE V

| Toner No. | Pigment | Triboelectric Charge ($\mu$c/g) |
|---|---|---|
| 2 | Black Pearl L | 24.5 |
| 4 | Cyan | 20.3 |
| 5 | Yellow | 18.2 |
| 6 | Magenta | 19.3 |
| 11 | Mitsubishi No. 44 | 21.7 |

Developers composed of the above coated granular steel and the respective toners were employed for development. In each case, copies having a beautiful image and good image quality were obtained even after development had been repeated 400,000 times.

EXAMPLE 5

A glass reaction vessel was charged with about 60 parts of methyl methacrylate, about 15 parts of styrene, about 25 parts of diethyl methacrylamide, about 0.5 part of azobisisobutyronitrile and 20 parts of toluene, and they were reacted in the same manner as in Example 1 to obtain a copolymer having a molecular weight of about 110,000. There was about 25% by weight diethyl methacrylamide present. This copolymer was coated on granular steel having a diameter of 450 $\mu$ in the same manner as in Example 1, and the triboelectric charge between the coated granular steel and various toners was determined to obtain the results shown in Table VI.

TABLE VI

| Toner No. | Pigment | Triboelectric Charge ($\mu$c/g) |
|---|---|---|
| 2 | Black Pear L | 20.5 |
| 3 | Mitsubishi No. 45 | 15.3 |
| 8 | Tokai Seast | 17.2 |
| 11 | Mitsubishi No. 44 | 16.9 |
| 12 | Tokai Seagal 600 | 15.5 |

Developers composed of the coated granular steel and the respective toners were used for development. In each case copies having a beautiful image and good image quality were obtained even after development had been repeated 500,000 times.

EXAMPLE 6

A glass reaction vessel was charged with about 80 parts of polymethyl methacrylate, about 20 parts of diethylamine, about 2 parts of metallic sodium and about 50 parts of toluene, and the mixture was heated at about 80° C under agitation for 60 hours. In the resulting reaction product the degree of modification was about 7% by weight. In the same manner as in Example 1 the copolymer diluted with toluene was coated on granular steel having a diameter of 450 $\mu$. After drying, the triboelectric charge between the coated granular steel and various toners was determined to obtain the results shown in Table VII.

TABLE VII

| Toner No. | Pigment | Triboelectric Charge ($\mu c/g$) |
|---|---|---|
| 2 | Black Pearl L | 22.8 |
| 7 | Mitsubishi No. 600 | 20.1 |
| 8 | Tokai Seast | 18.2 |
| 9 | Tokai Seast 3H | 17.7 |
| 10 | Mitsubishi No. 33 | 15.4 |

Developers composed of the coated granular steel and the respective toners were used for development. In each case copies having a beautiful image and good image quality were obtained even after development had been repeated 500,000 times.

EXAMPLES 7–11

In the same manner as in Example 1, the polymer and the monomer were synthesized by varying the ratio of the polymer and monomer, and then the copolymer was applied to granular steel having a diameter of 450 $\mu$, and the triboelectric charge was determined with respect to toners produced by Black Pear L Tokai Seast 3H to obtain the results shown in Table VIII.

TABLE VIII

| Ex. | Monomer | Polymer Ratio (% by weight) | Tribo-electric Charge Black Pear L | Tribo-electric Charge Tokai Seast 3H |
|---|---|---|---|---|
| 7 | diethylaminoethyl meth-acrylate:methylmetacrylate | 0.08:99.02 | 25.3 | 18.5 |
| 8 | diethylaminoethyl methacrylate | 100 | 18.2 | 13.4 |
| 9 | dimethylaminoethyl methacrylate:methyl-methacrylate:styrene | 12:73:15 | 18.3 | 15.2 |
| 10 | diethylmethacrylamide: methyl | 5:95 | 26.2 | 20.0 |
| 11 | diethylamino methacrylate: methylmethacrylate: chloroethylvinyl ether | 2:96:2 | 19.2 | 15.4 |

In Example 8, the humidity dependency of the triboelectric charge is greater than that in the other Examples. The percent by weight of the components listed under the heading "Monomer" in the resulting polymer are in the same order under the heading "Polymer Ratio" as that of the components.

What is claimed is:

1. A xerographic reproduction process comprising the steps of forming an electrostatic latent image on a recording layer and developing the image with a developer comprising a toner and a carrier, the carrier comprising a core coated with an organic polymer coating containing about 0.01% by weight to 100% by weight of a monomer unit having the following formula

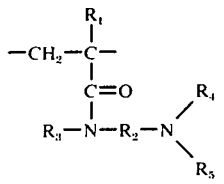

where $R_1$, $R_3$, $R_4$ and $R_5$ are each a hydrogen atom or a hydrocarbon residue having 1 to 12 carbon atoms and $R_2$ is a hydrocarbon residue having 1 to 12 carbon atoms, said organic polymer coating being selected from the group consisting of 1. a homopolymer of a first monomer selected from the group consisting of dimethylaminoethyl methacrylamide, dimethylaminopropyl methacrylamide, dimethylaminobutyl methacrylamide, dimethylaminohexyl methacrylamide, dimethylaminodecyl methacrylamide, diethylaminoethyl methacrylamide, diethylaminobutyl methacrylamide, dipropylaminoethyl methacrylamide, dibutylaminoethyl methacrylamide, dimethylaminoethyl acrylamide, dimethylaminopropyl acrylamide, dimethylaminobutyl acrylamide, dimethylaminohexyl acrylamide, dimethylaminodecyl acrylamide, diethylaminoethyl acrylamide, diethylaminobutyl acrylamide, dipropylaminoethyl acrylamide and dibutylaminoethyl acrylamide;
2. a copolymer of (a) said first monomer and (b) a second monomer selected from the group consisting of alkyl acrylate, alkyl methacrylate, cycloalkyl acrylate, cycloalkyl methacrylate, hydroxyalkyl acrylate, hydroxyalkyl methacrylate, acrylamide, methacrylamide, alkylol acrylamide, alkylol methacrylamide, acrylonitrile, methacrylonitrile, styrene, vinyltoluene, vinyl acetate and vinyl chloride; and
3. a polymer formed by reacting with a starting polymer selected from the group consisting of polymethacrylic acid, polymethyl methacrylate, polyethyl methacrylate, polypropyl methacrylate, polybutyl methacrylate, polyacrylic acid, polymethyl acrylate, polyethyl acrylate, polypropyl acrylate and polybutyl acrylate and copolymers and terpolymers thereof, a reagent selected from the group consisting of compounds having the following formula

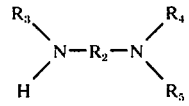

(a)

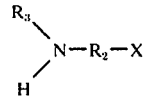

(b)

-continued

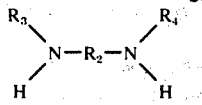

(c)

where a first further reagent having the following formula is reacted with said starting polymer subsequent to the reaction of said reagent having the above formula (b):

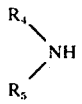

(d)

where a second further reagent having the following formula is reacted with said starting polymer subsequent to the reaction of said reagent having the above formula (c):

$X - R_{25}$ and where $R_2$, $R_3$, $R_4$ and $R_5$ are as defined hereinbefore and X is a halogen atom.

2. A process as in claim 1 where the thickness of said polymer coating is at least 0.1 $\mu$.

3. A process as in claim 1 where said polymer coating consists essentially of a homopolymer of said one monomer unit.

4. A process as in claim 1 where said polymer coating consists essentially of a copolymer of said one monomer unit and another comonomer.

5. A process as in claim 1 where said polymer coating consists essentially of donee polymer having incorporated therein said one monomer unit, said donee polymer having a chemical structure different than that of said one monomer unit prior to the incorporation therein of said monomer unit.

6. A process as in claim 3 where said polymer coating consists of a mixture of said organic polymer and another polymer.

7. A process as in claim 1 where said polymer coating contains about 0.05 to about 50% by weight of said monomer unit.

8. A process as in claim 1 where said polymer coating contains about 75% to about 90% by weight of said monomer unit.

9. A carrier for use in a developer for a xerographic reproduction process where the developer comprises a toner and a carrier having a diameter of about 40 to 600 microns, said carrier comprising a core coated with a continuous film of an organic polymer coating containing about 0.01% by weight to 100% by weight of a monomer unit having the following formula

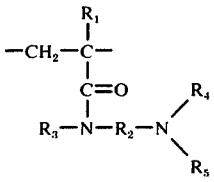

where $R_1$, $R_3$, $R_4$, and $R_5$ are each a hydrogen atom or a hydrocarbon residue having 1 to 12 carbon atoms and $R_2$ is a hydrocarbon residue having 1 to 12 carbon atoms, said organic polymer coating being selected from the group consisting of 1. a homopolymer of a first monomer selected from the group consisting of dimethylaminoethyl methacrylamide, dimethylaminopropyl methacrylamide, dimethylaminobutyl methacrylamide, dimethylaminohexyl methacrylamide, diemthylaminodecyl methacrylamide, diethylaminoethyl methacrylamide, diethylaminobutyl methacrylamide, dipropylaminoethyl methacrylamide, dibutylaminoethyl methacrylamide, dimethylaminoethyl acrylamide, dimethylaminopropyl acrylamide, dimethylaminobutyl acrylamide, dimethylaminohexyl acrylamide, dimethylaminodecyl acrylamide, diethylaminoethyl acrylamide, diethylaminobutyl acrylamide, dipropylaminoethyl acrylamide and dibutylaminoethyl acrylamide;
2. a copolymer of (a) said first monomer and (b) a second monomer selected from the group consisting of alkyl acrylate, alkyl methacrylate, cycloalkyl acrylate, cycloalkyl methacrylate, hydroxyalkyl acrylate, hydroxyalkyl methacrylate, acrylamide, methacrylamide, alkylol acrylamide, alkylol methacrylamide, acrylonitrile, methacrylonitrile, styrene, vinyltoluene, vinyl acetate and vinyl chloride; and
3. a polymer formed by reacting with a starting polymer selected from the group consisting of polymethacrylic acid, polymethyl methacrylate, polyethyl methacrylate, polypropyl methacrylate, polybutyl methacrylate, polyacrylic acid, polymethyl acrylate, polyethyl acrylate, polypropyl acrylate and polybutyl acrylate and copolymers and terpolymers thereof, a reagent selected from the group consisting of compounds having the following formula

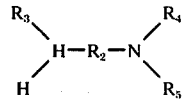

(a)

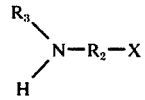

(b)

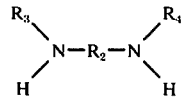

(c)

where a first further reagent having the following formula is reacted with said starting polymer subsequent to the reaction of said reagent having the above formula (b):

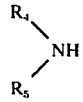

(d)

where a second further reagent having the following formula is reacted with said starting polymer subsequent to the reaction of said reagent having the above formula (c):

$X - R_5$ and where $R_2$, $R_3$, $R_4$ and $R_5$ are as defined hereinbefore and X is a halogen atom.

10. A carrier as in claim 9 where the thickness of said polymer coating is at least 0.1 $\mu$.

11. A carrier as in claim 9 where said polymer coating consists essentially of a homopolymer of said one monomer unit.

12. A carrier as in claim 9 where said polymer coating consists essentially of a copolymer of said one monomer unit and another comonomer.

13. A carrier as in claim 9 coating consists essentially of donee polymer having incorporated therein said one monomer unit, and donee polymer having a chemical structure different than that of said one monomer unit prior to the incorporation therein of said monomer unit.

14. A carrier as in claim 9 where said polymer coating consists of a mixture of said organic polymer and another polymer.

15. A carrier as in claim 9 where said polymer coating contains about 0.05 to about 50% by weight of said monomer unit.

16. A carrier as in claim 9 where said polymer coating contains about 75% to about 90% by weight of said monomer unit.

17. A carrier as in claim 9 where said core is made from a material selected from the group consisting of sodium chloride, ammonium chloride, potassium chloride, potassium aluminum chloride, Rochelle salt, sodium nitrate, potassium chlorate, granular zirconium, granular silicon, polymethyl methacrylate, glass, silicon dioxide, flint shot, iron, steel, ferrite, nickel, carborundum and mixtures thereof.

* * * * *